US005927758A

United States Patent [19]

Carlsson

[11] Patent Number: 5,927,758

[45] Date of Patent: Jul. 27, 1999

[54] PIVOTABLE VACUUM CLEANER TUBE SHAFT

[75] Inventor: Arne Carlsson, Trelleborg, Sweden

[73] Assignee: Aktiebolaget Electrolux, Stockholm, Sweden

[21] Appl. No.: 09/033,732

[22] Filed: Mar. 3, 1998

[30] Foreign Application Priority Data

Apr. 7, 1997 [SE] Sweden ..... 9701257

[51] Int. Cl.[6] ..... F16L 35/00

[52] U.S. Cl. ..... 285/7; 285/184; 285/298

[58] Field of Search ..... 285/7, 184, 298, 285/302

[56] References Cited

U.S. PATENT DOCUMENTS 689,894 12/1901 Lutz ..... 285/184

2,203,088 6/1940 Hansson ..... 285/7

2,637,062 5/1953 Sutton et al. ..... 285/7 X 3,159,412 12/1964 Descarries ..... 285/7

4,079,965 3/1978 Moughty et al. ..... 285/7

*Primary Examiner*—Dave W. Arola

*Attorney, Agent, or Firm*—Pearne, Gordon, McCoy & Granger LLP

[57] ABSTRACT

A vacuum cleaner tube shaft having a first tube shaped part (11) and a second tube shaped part (12). The first part is slidably arranged in the second part and is adapted to be releasably locked to the second part in a desired position. The second part (12) includes two sections (15, 16) which are connected to each other via a pivot (17). When the first part (11) is inserted in the two sections (15, 16), the two sections are aligned with respect to each other. When the first part is inserted into only one section (15) of the second part, the sections (15, 16) can be positioned in a desired angular position with respect to each other.

13 Claims, 3 Drawing Sheets

PIVOTABLE VACUUM CLEANER TUBE SHAFT

BACKGROUND OF THE INVENTION

The present invention generally relates to a vacuum cleaner tube shaft having a first tube shaped part and a second tube shaped part and, more specifically, to such a tube shaft wherein the first tube shaped part is slidably arranged in the second tube shaped part and is releasably fixed in a desired position by a locking means.

Vacuum cleaners conventionally comprise an electrically driven suction unit having a hose connected thereto. An opposite end of the hose is connected to a vacuum cleaner tube shaft which has a removable nozzle at its outer end. The length of the vacuum cleaner tube shaft is selected to fit an operator having a normal height in order to make it possible to work in a comfortable position. The vacuum cleaner tube shaft may be manufactured as two telescopically adjustable tube parts in order to permit adjustment of the tube shaft length. Locking of the tube parts is effected, either by stepwise or continuous adjustment, by means of a locking means arranged between the tubes.

Different types of nozzles may be connected to the vacuum cleaner tube shaft, depending on the nature and the accessibility of the surface being cleaned. It is, however, often difficult to reach surfaces with the vacuum cleaner nozzle which are located beneath furniture or other structures. The operator is usually forced to work in uncomfortable, non-ergonomic and, sometimes, detrimental and bodily unsuitable working positions.

In order to avoid these problems, different types of solutions have been suggested. For instance, there are nozzles having a pivotable connection part which is coupled to the vacuum cleaner tube shaft. Such pivotable nozzle connections make it possible to use a large angle between the nozzle and the vacuum cleaner tube shaft and, hence, facilitates cleaning of hard to reach surfaces. An example of such a nozzle is described in U.S. Pat. No. 4,537,424. However, usually only the primary cleaning nozzle is provided with such a link which means that the accessibility problem remains for other secondary nozzles commonly used with vacuum cleaners.

SUMMARY OF THE INVENTION

The present invention is directed toward a device which eases cleaning of surfaces which are difficult to reach and which may be used with all types of nozzles.

In accordance with the present invention, a vacuum cleaner tube shaft has a first tube shaped part and a second tube shaped part. The first part is slidably received in the second tube part and is releasably locked in a desired position by a locking means. The second part includes a first or upper section and a second or lower section. The upper and lower sections are connected to each other by a pivot.

In further accordance with the present invention, the pivot permits insertion of the first tube shaped part into the upper and lower sections of the second part when the upper and lower sections are aligned with each other. The pivot is operable to adjust the upper and lower sections to a desired angled position with respect to each other when the first part is inserted into only one of the upper and lower sections.

In further accordance with the present invention, the pivot includes two pivot halves having a parting plane which is angled with respect to a longitudinal axis of the upper and lower sections. Edges of the pivot halves define outwardly bent flanges. A locking ring engages the flanges to secure the pivot halves to one another, while permitting rotary motion of the pivot halves with respect to each other in order to turn the upper and lower sections with respect to each other.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
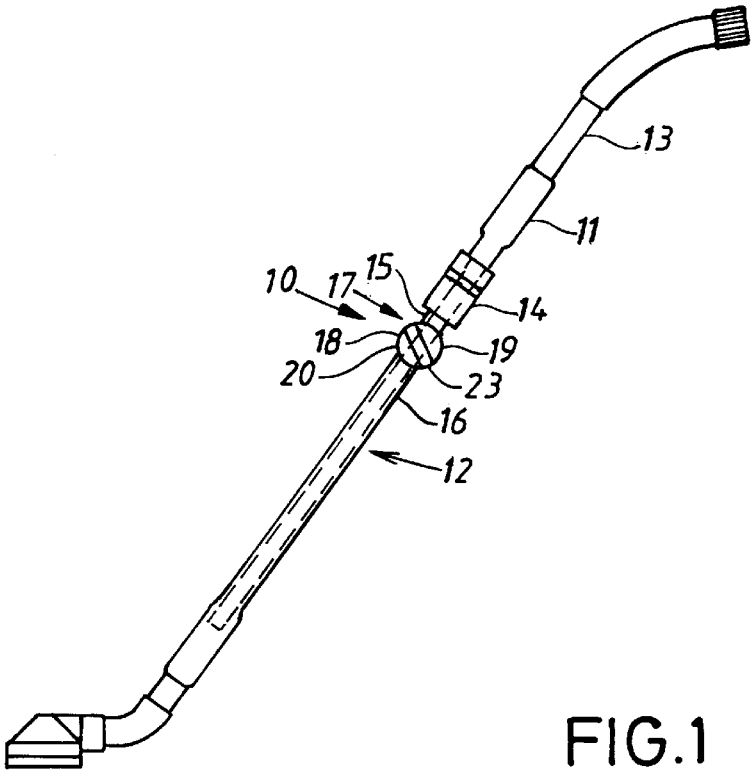
FIG. 1 is a side view of a vacuum cleaner tube shaft according to the present invention in a retracted position.

It should be noted that in the detailed description which follows, identical components have the same reference numeral, regardless of whether they are shown in different embodiments of the present invention. It should also be noted that, in order to clearly and concisely disclose the present invention, the drawings may not necessarily be to scale and certain features of the invention may be shown in somewhat schematic form.

Figure 2:
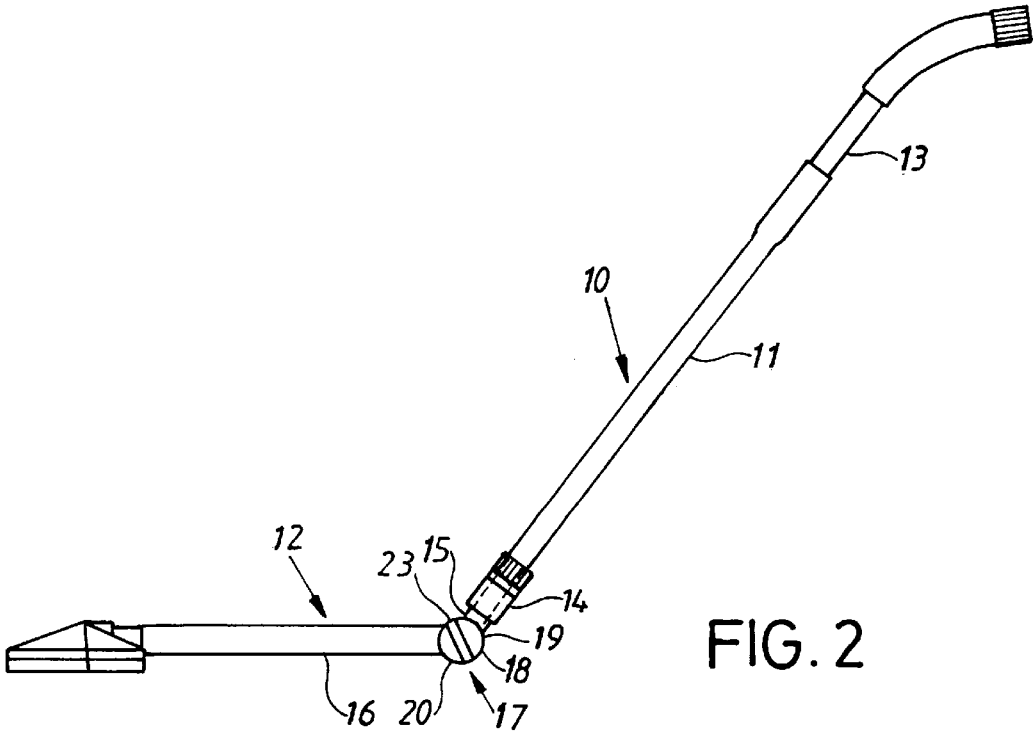
FIG. 2 is a side view of the vacuum cleaner tube shaft in an extended and angled position.

With reference to FIGS. 1 and 2, a vacuum cleaner tube shaft 10 according to the present invention is illustrated. The tube shaft 10 includes a first tube shaped part 11 and a second tube shaped part 12. One end of the first part 11 is connected to a coupling 13 of a vacuum cleaner hose (not shown), while the other end is slidably received in the second part 12 of the vacuum cleaner tube shaft 10.

A locking means 14 is arranged at the upper end of the second part 12 and is operable to releasably lock the first part 11 in any position relative to the second part 12. Thus, it is possible to vary the length of the vacuum cleaner tube shaft 10 by telescopically sliding the first part 11 in the second part 12 and, when the tube shaft 10 is at a desired length, locking the first part 11 to the second part 12 by simply turning the locking means 14.

Near the locking means 14, the second tube 12 is divided into a first or upper section 15 and a second or lower section 16. The upper and lower sections 15, 16 are connected to each other via a pivot 17. The locking means 14 is arranged on the upper section 15, as illustrated.

In the first embodiment illustrated in FIGS. 1–4, the pivot 17 is provided by a sphere 18 which is divided into two cup shaped pivot halves 19, 20. The pivot halves 19, 20 have a parting plane aligned obliquely with respect to the longitudinal axis of the vacuum cleaner tube shaft 10. The angle is preferably between about 30°–70° and, more preferably about 65°. The cup shaped pivot halves 19, 20 are firmly secured to the upper and lower sections 15, 16, respectively. The pivot halves 19, 20 have outwardly bent flanges 21, 22 at their edges which are held together by an outer locking ring 23 which surrounds the flanges 21, 22.

The locking ring 23 is preferably made of plastic or rubber, and is U-shaped in cross-section. The locking ring 23 receives the flanges 21, 22 of each of the pivot halves 19, 20, and permits the pivot halves 19, 20 to be rotated with respect to each other. Between the flanges 21, 22 on the pivot halves 19, 20, a ring (not shown), preferably of nylon or similar material, can be arranged. The friction or interference between the pivot halves 19, 20 is such that the pivot halves can be manually turned with respect to each other and be kept in a turned position.

Figure 4:
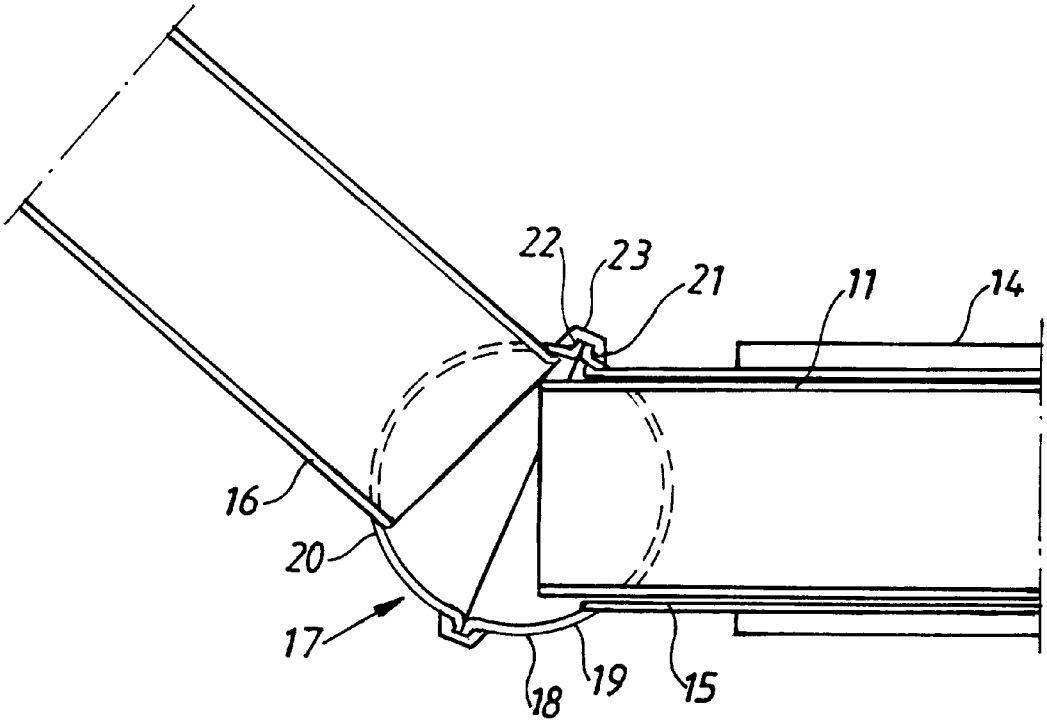
FIG. 4 is an enlarged axial section view of the pivot, showing the vacuum cleaner tube shaft in the extended and angled position.

As shown best in FIGS. 2 and 4, when the first tube 11 is fully withdrawn from the lower section 16 of the second tube 12 it is possible, by turning the lower section 16 and the pivot half 20 180° with respect to the upper section 15 and the pivot half 19, to achieve an angle of between about 120–130° of the vacuum cleaner tube shaft 10. For an optimal ergonomic working position it is preferred that the angle of the vacuum cleaner tube shaft 10 be about 125°.

Figure 3:
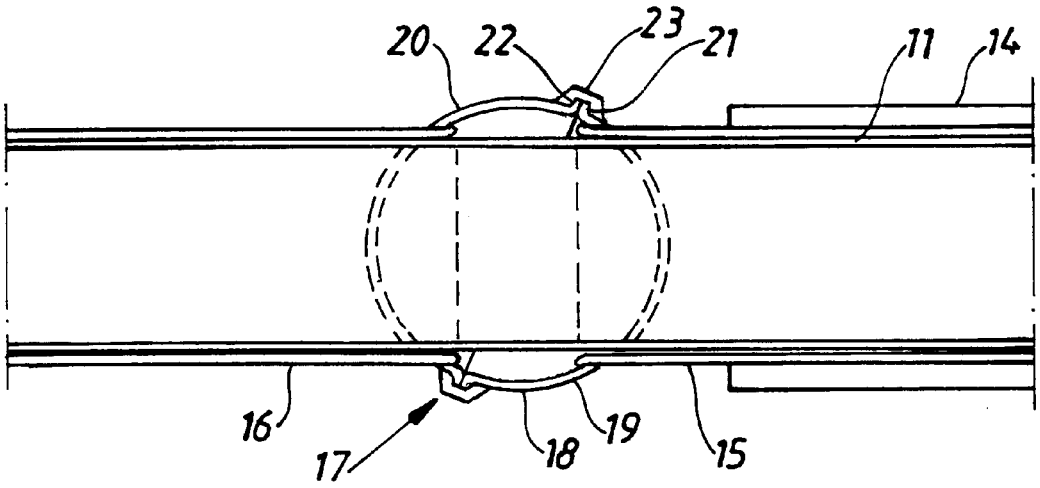
FIG. 3 is an enlarged axial section view of a pivot, showing the vacuum cleaner tube shaft in the retracted position.

As is shown best in FIGS. 1 and 3, the pivot 17 does not interfere with the telescopic function of the vacuum cleaner tube shaft 10. Rather, it is still possible to slide the first part 11 of the vacuum cleaner tube shaft into the lower section 16 of the second part 12 when the upper and lower sections 15, 16 are in line with each other. In fact, telescopic receipt of the first part 11 beyond the pivot 17 increases the stiffness of the pivot 17.

Figure 5:
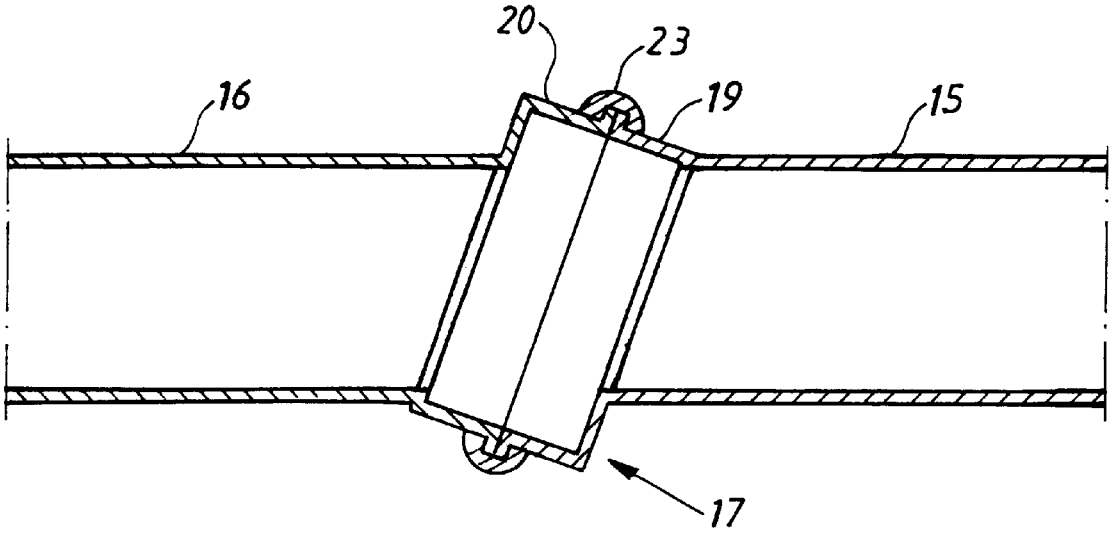
FIG. 5 is an enlarged axial section view of an alternative embodiment of the vacuum cleaner tube shaft pivot.
Figure 6:
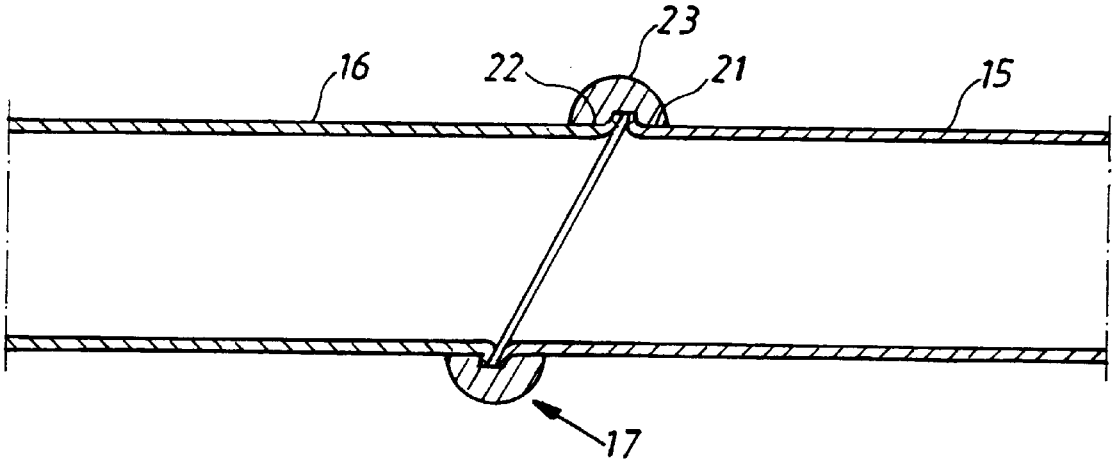
FIG. 6 is an enlarged axial section view of a further alternative embodiment of the vacuum cleaner tube shaft pivot according to the present invention.

It is contemplated that numerous pivots in addition to that illustrated in FIGS. 3 and 4 may be utilized in practicing the present invention. The pivot 17 can be designed differently, provided that the pivot 17 allows the telescopic extension/retraction of the first and second tube parts 11, 12. For example, and with reference to FIG. 5, instead of the sphere 18, the pivot 17 is provided by two cylinder-shaped pivot halves 19, 20 having a parting plane inclined with respect to the longitudinal axis of the upper and lower sections 15 and 16. With reference to FIG. 6, in a further alternative design of the pivot 17 the sections 15 and 16 are cut obliquely and bent outwardly at the ends. The upper and lower sections 15, 16 which form the pivot halves 19, 20, respectively, are rotatably secured to one another by a locking ring 23, according to the previously described embodiment.

It is also contemplated that the telescopic design described hereinbefore could be reversed. Thus, the second or lower part 12 can telescopically slide in the first or upper part 11 and be locked in the same manner as has been described above by the locking means 14. The locking means 14 would, in this case, be arranged on the lower part 12, and the first part 11 would comprise a first or upper section and a second or lower section which are rotatably connected to one another by the pivot 17, as described hereinbefore.

Use of the pivoting vacuum cleaner tube shaft according to the present invention greatly eases and facilitates cleaning underneath furniture. The angular setting of the vacuum cleaner tube shaft 10 is not limited to the use of certain types of nozzles, which means increased accessibility for the user for all types of cleaning without uncomfortable or harmful working positions.

While the preferred embodiment of the present invention is shown and described herein, it is to be understood that the same is not so limited but shall cover and include any and all modifications thereof which fall within the purview of the invention.

What is claimed is:

1. A vacuum cleaner tube shaft (10) comprising a first tube shaped part (11) and a second tube shaped part (12), said first part (11) being slidably received in said second part (12) and being releasably locked in a desired position by a locking means (14), wherein said second part (12) comprises a first section (15) and a second section (16), said first and second sections (15, 16) being connected to each other via a pivot, first and second sections and said first part being so constructed and arranged for (17), said pivot permitting insertion of the first part (11) into the first and second sections (15, 16) of the second part (12) when said first and second sections are aligned with each other, said pivot (17) being operable to adjust said first and second sections to a desired angled position with respect to each other when the first part (11) is inserted in only one of said first and second sections (15).

2. A vacuum cleaner tube shaft according to claim 1, wherein the pivot (17) comprises two pivot halves (19, 20) having a parting plane which is angled with respect to a longitudinal axis of the first and second sections (15, 16).

3. A vacuum cleaner tube shaft according to claim 2, wherein a ring is disposed between the two pivot halves (19, 20), said ring being formed from one of a plastic and a rubber material.

4. A vacuum cleaner tube shaft according to claim 3, wherein said ring is formed from nylon.

5. A vacuum cleaner tube shaft according to claim 2, wherein the angle of the parting plane with respect to the longitudinal axis of the first and second sections (15, 16) is between about 60°–70°.

6. A vacuum cleaner tube shaft according to claim 5, wherein the angle is about 65°.

7. A vacuum cleaner tube shaft according to claim 5, wherein edges of said two pivot halves (19, 20) define outwardly bent flanges (21,22).

8. A vacuum cleaner tube shaft according to claim 7, wherein a ring is disposed between the two pivot halves (19, 20), said ring being formed from one of a plastic and a rubber material.

9. A vacuum cleaner tube shaft according to claim 8, wherein said ring is formed from nylon.

10. A vacuum cleaner tube shaft according to claim 7, wherein the pivot halves (19, 20) are secured to each other by means of a locking ring (23), said locking ring (23) engaging the flanges and permitting rotary motion of the pivot halves (19, 20) with respect to each other in order to turn the first and second sections (15, 16) with respect to each other.

11. A vacuum cleaner tube shaft according to claim 10, wherein the locking ring (23) is made from at least one of a plastic and a rubber material.

12. A vacuum cleaner tube shaft according to claim 10, wherein a ring is disposed between the two pivot halves (19, 20), said ring being formed from one of a plastic and a rubber material.

13. A vacuum cleaner tube shaft according to claim 12, wherein said ring is formed from nylon.

* * * * *